US008985721B2

(12) United States Patent
Tomizawa et al.

(10) Patent No.: US 8,985,721 B2
(45) Date of Patent: Mar. 24, 2015

(54) PRINTING APPARATUS AND AGING METHOD

(71) Applicant: Canon Kabushiki Kaisha, Tokyo (JP)

(72) Inventors: Keiji Tomizawa, Yokohama (JP); Chiaki Muraoka, Kawaguchi (JP); Takuma Kodoi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/095,096

(22) Filed: Dec. 3, 2013

(65) Prior Publication Data

US 2014/0152725 A1 Jun. 5, 2014

(30) Foreign Application Priority Data

Dec. 5, 2012 (JP) ..... 2012-266739
Oct. 8, 2013 (JP) ..... 2013-211433

(51) Int. Cl.
*B41J 29/38* (2006.01)
*B41J 2/165* (2006.01)
*B41J 19/14* (2006.01)

(52) U.S. Cl.
CPC ..... *B41J 2/16526* (2013.01); *B41J 19/145* (2013.01)
USPC ..... 347/9; 347/16

(58) Field of Classification Search
CPC .. B41J 2/04541; B41J 2/04513; B41J 2/0458; B41J 2/04581; B41J 2/04563; B41J 2/04598; B41J 29/393
USPC ..... 347/9, 14
See application file for complete search history.

(56) References Cited

U.S. PATENT DOCUMENTS 6,409,298 B1 * 6/2002 Ahne et al. ..... 347/14
6,565,176 B2 * 5/2003 Anderson et al. ..... 347/14

FOREIGN PATENT DOCUMENTS

JP 2004-262066 A 9/2004

* cited by examiner

*Primary Examiner* — Jannelle M Lebron
*Assistant Examiner* — Jeremy Bishop
(74) *Attorney, Agent, or Firm* — Fitzpatrick, Cella, Harper & Scinto

(57) ABSTRACT

An embodiment of this invention is directed to preventing a decrease in the number of media printable with ink in an ink tank owing to an increase in waste ink in aging processing, and an increase in aging processing time. According to the embodiment, aging processing is executed as follows in a printing apparatus in which a printhead including a plurality of nozzles and a nozzle array formed from these nozzles and discharge ink is reciprocally scanned in a direction different from the direction of the nozzle array, and an image is printed by forward printing and backward printing. The aging processing is performed by changing the count at which the aging processing is performed, between nozzles at the edge side portion of the nozzle array and nozzles at the center side portion of the nozzle array.

19 Claims, 6 Drawing Sheets

INITIAL PRINTING (AFTER AGING PROCESSING)

a
b
c
INITIAL RECIPROCAL PRINTING
RECIPROCAL PRINTING AFTER USE
FORWARD
BACKWARD
B
A
B
B
A
B
JOINT IN RECIPROCATION

DISCHARGE COUNT AND DISCHARGE VELOCITY
DISCHARGE VELOCITY
PA
PB
DISCHARGE COUNT
AGING d
FORWARD
BACKWARD
F E D C D E F
F E D C D E F
JOINT IN RECIPROCATION
e
INITIAL RECIPROCAL PRINTING
f
RECIPROCAL PRINTING AFTER USE

DISCHARGE COUNT AND DISCHARGE VELOCITY
DISCHARGE VELOCITY
PC
PD
PE
PF
DISCHARGE COUNT
AGING

PRINTING APPARATUS AND AGING METHOD

BACKGROUND OF THE INVENTION

1. Field of the Invention

The present invention relates to a printing apparatus and aging method and, particularly, to an inkjet printing apparatus which prints by discharging ink droplets to a printing medium, and an aging method therefor.

2. Description of the Related Art

Recently, inkjet printing of discharging ink from orifices to form and print an image or the like on printing paper has been widely adopted as a printing method for printing apparatuses because it is non-impact printing and is capable of low-noise, high-density, and high-speed printing. A printing apparatus of this type includes a mechanism which drives a carriage supporting an inkjet printhead (to be referred to as a printhead hereinafter), a conveyance mechanism which conveys a printing medium such as printing paper, and a control unit which controls them.

The following methods have been conventionally known as a method of generating energy for discharging ink from the orifice of a printhead: a method of pressurizing ink by using an electromechanical transducer such as a piezoelectric element; a method of using the pressure of a bubble generated by heat generated by irradiation of an electromagnetic wave such as a laser beam; and a method of heating and bubbling ink by an electrothermal transducer (to be referred to as a heater hereinafter).

In a printhead using an energy generation method using a heater, when ink is heated by the heater and burned on the surface of the heater, the ink discharge velocity relatively greatly changes in some cases. The coloring agent of the ink used in this printhead is often a dye or pigment. These coloring agents are insoluble or hardly-soluble in water, and thus the ink is considered to be burned on the heater.

The burn causes several problems. For example, if the discharge velocity changes owing to burn, the landing position of ink discharged in the forward direction and that of ink discharged in the backward direction shift from each other in printing by reciprocal scanning of the printhead (to be referred to as a registration error in the reciprocal direction hereinafter). This impairs the reproducibility of a fine portion of an image or a thin line (especially a vertical ruled line), resulting in poor image quality.

An attempt has been made to perform preliminary discharge (to be referred to as aging hereinafter) not contributing to printing on a printing medium by a printhead, accelerate the burn of ink attached to the heater surface to some degree, and uniform the burn on the heater surface so as to stabilize ink discharge. In aging, a target orifice performs the same ink discharge operation as normal ink discharge. However, for example, a pulse of a voltage value larger than a voltage pulse normally applied in printing is applied to the electrothermal transducer, or a pulse is applied for a time longer than the time of a normally applied pulse. This ink discharge operation can uniform the burn on the heater surface and stabilize ink discharge.

In the aging operation, ink is discharged into a dedicated ink receptor or cap, similar to the preliminary discharge operation in recovery processing. Aging processing is sometimes started in accordance with, for example, an instruction input by the user or an automatic sequence when a printing apparatus is used for the first time after purchase or when a detachable printhead is mounted.

The above-described conventional technique is disclosed in, for example, Japanese Patent Laid-Open No. 2004-262066.

However, when the user uses a printing apparatus for the first time after purchase or when a detachable printhead is mounted, if aging processing is performed for all nozzles, a large amount of ink is wasted. In addition, the number of media printable with ink contained in an ink tank at the beginning of use decreases disadvantageously.

Further, if aging is performed for all nozzles, the temperature of the printhead rises and abnormal discharge occurs. To avoid this, the printing apparatus needs to stand by until the temperature of the printhead becomes equal to or lower than a predetermined value during aging. As a result, aging processing takes a long time. These problems are becoming more serious than in the conventional printing apparatus because of a large number of nozzles (long printing length) integrated in a printhead for recent high-speed printing.

SUMMARY OF THE INVENTION

Accordingly, the present invention is conceived as a response to the above-described disadvantages of the conventional art.

For example, a printing apparatus and aging method according to this invention are capable of performing high-speed aging processing and high-quality printing in which a registration error does not stand out in the reciprocal scanning direction, while reducing the waste ink amount and ensuring the number of media printable with ink in an ink tank.

According to one aspect of the present invention, there is provided a printing apparatus in which a printhead including a plurality of electrothermal transducers and a nozzle array formed from a plurality of nozzles configured to correspond to the plurality of electrothermal transducers and discharge ink is reciprocally scanned in a direction different from a direction of the nozzle array, and an image is printed on a printing medium by forward printing and backward printing by the printhead. The apparatus comprises a control unit configured to control to perform aging processing by changing a count at which the aging processing is performed, between the electrothermal transducers corresponding to the nozzles at an edge side portion of the nozzle array and the electrothermal transducers corresponding to nozzles at a center side portion of the nozzle array.

According to another aspect of the present invention, there is provided an aging method for a printing apparatus in which a printhead including a plurality of electrothermal transducers and a nozzle array formed from a plurality of nozzles configured to correspond to the plurality of electrothermal transducers and discharge ink is reciprocally scanned in a direction different from a direction of the nozzle array, and an image is printed on a printing medium by forward printing and backward printing by the printhead. The method comprises controlling to perform aging processing by changing a count at which the aging processing is performed, between nozzles at an edge side portion of the nozzle array and nozzles at a center side portion of the nozzle array.

According to still another aspect of the present invention, there is provided an aging method for a liquid discharge head. The method comprises: providing a liquid discharge head including an electrothermal transducer array in which a plurality of electrothermal transducers configured to generate energy to be used to discharge a liquid are arrayed, and a plurality of orifices configured to be formed in accordance with the electrothermal transducers and discharge a liquid; and performing aging processing for at least part of the plurality of electrothermal transducers included in the electrothermal transducer array, wherein an aging count for electrothermal transducers at an edge side portion of the electrothermal transducer array is larger than an aging count for electrothermal transducers at a center side portion of the electrothermal transducer array.

The invention is particularly advantageous since a registration error in the reciprocal scanning direction can be made inconspicuous while reducing the waste ink amount and ensuring the number of media printable with ink in an ink tank. Also, aging processing can be executed quickly.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" generically means an ink orifice or a liquid channel communicating with it, and an element for generating energy used to discharge ink, unless otherwise specified.

Especially, in this embodiment, an electrothermal transducer (heater) 102*a* is used as an element for generating energy to be used for ink discharge. The heater is energized to generate heat, and ink is discharged by the bubbling force of a bubble generated near the orifice by the heat.

Figure 1:
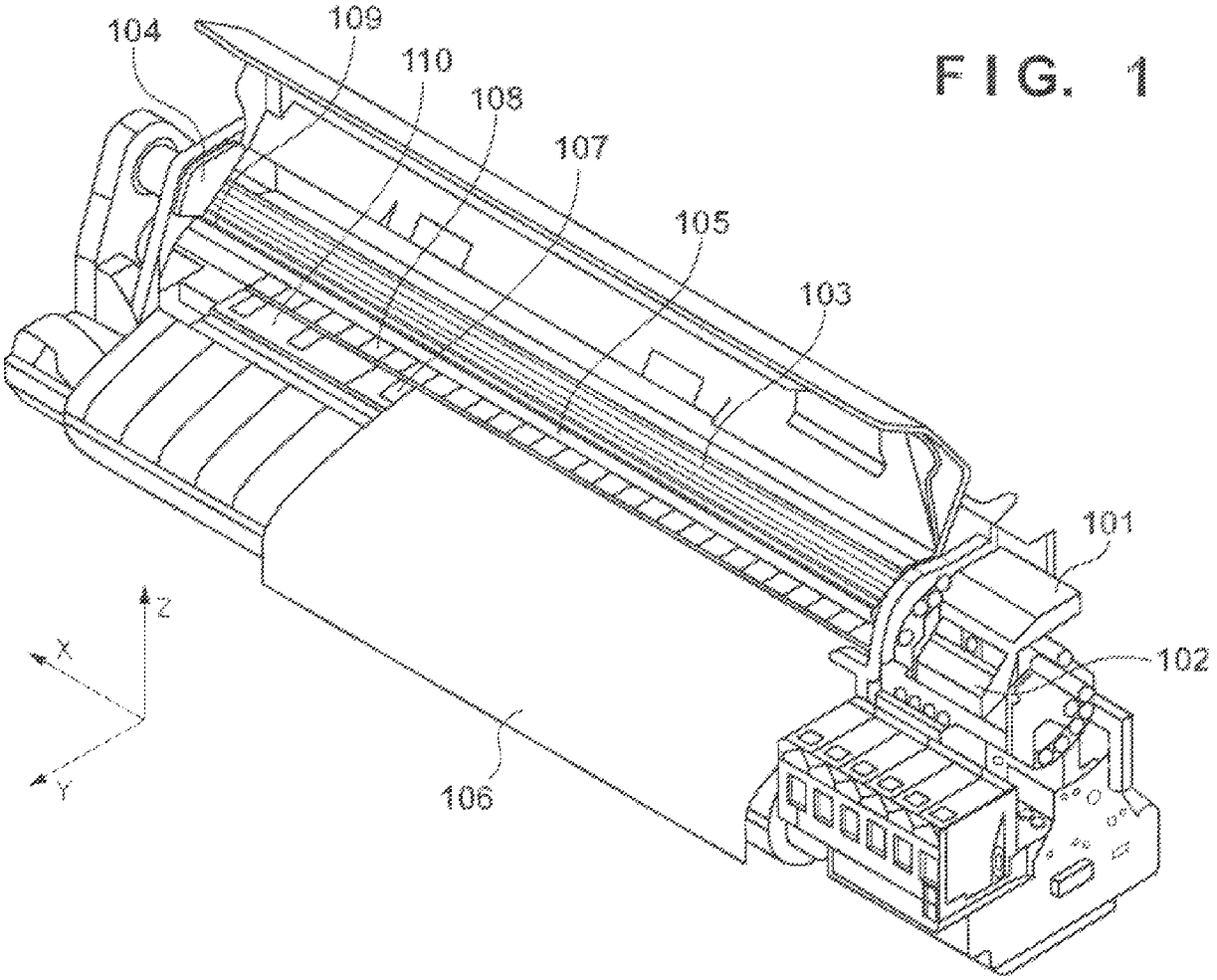
FIG. 1 is a perspective view showing the schematic arrangement of an inkjet printing apparatus as an exemplary embodiment.

FIG. 1 is a perspective view showing the schematic arrangement of an inkjet printing apparatus (to be referred to as a printing apparatus hereinafter) 1 as an exemplary embodiment.

As shown in FIG. 1, a carriage 101 supports an inkjet printhead (to be referred to as a printhead hereinafter) 102 on which a plurality of printing elements (heaters) are arrayed. The carriage 101 is connected to a carriage motor (CR motor) 104 via a conveyance belt 103. The carriage 101 reciprocally scans along the X-axis on a shaft 105 by rotation of the CR motor 104. When the carriage 101 passes on a printing medium 106 such as printing paper, ink droplets are discharged upon heating by the heaters from a plurality of nozzles arrayed on the printhead 102 in a direction perpendicular to the scanning direction (main scanning direction) of the carriage 101. The ink droplets are discharged at a timing corresponding to printing data, forming an image on the printing medium 106.

The printing medium 106 is nipped by a line feed roller (LF roller) 107 and a pinch roller 108, and is conveyed on a platen 110 in a direction (sub-scanning direction) perpendicular to the main scanning direction by rotation of an LF motor (conveyance motor) 109 connected to the LF roller 107. The platen 110 has a plurality of holes, and air is sucked through these holes by rotation of a platen suction fan (not shown), holding the printing medium 106 on the platen 110. Hence, the floating of the printing medium 106 during the printing operation is suppressed.

Although not shown in FIG. 1, a recovery unit is arranged near the home position of the carriage 101 to recover the printhead 102. The recovery unit includes a suction pump which sucks highly viscous ink from the printhead 102, a blade which wipes the ink discharge surface of the printhead 102, a cap which caps the ink discharge surface, and an ink receptor which receives preliminary discharged ink.

Aging processing to be described in this embodiment is preliminary discharge of discharging ink irrelevant to printing from the printhead 102. Thus, part of the recovery unit plays part of a role in executing aging processing.

Figure 2:
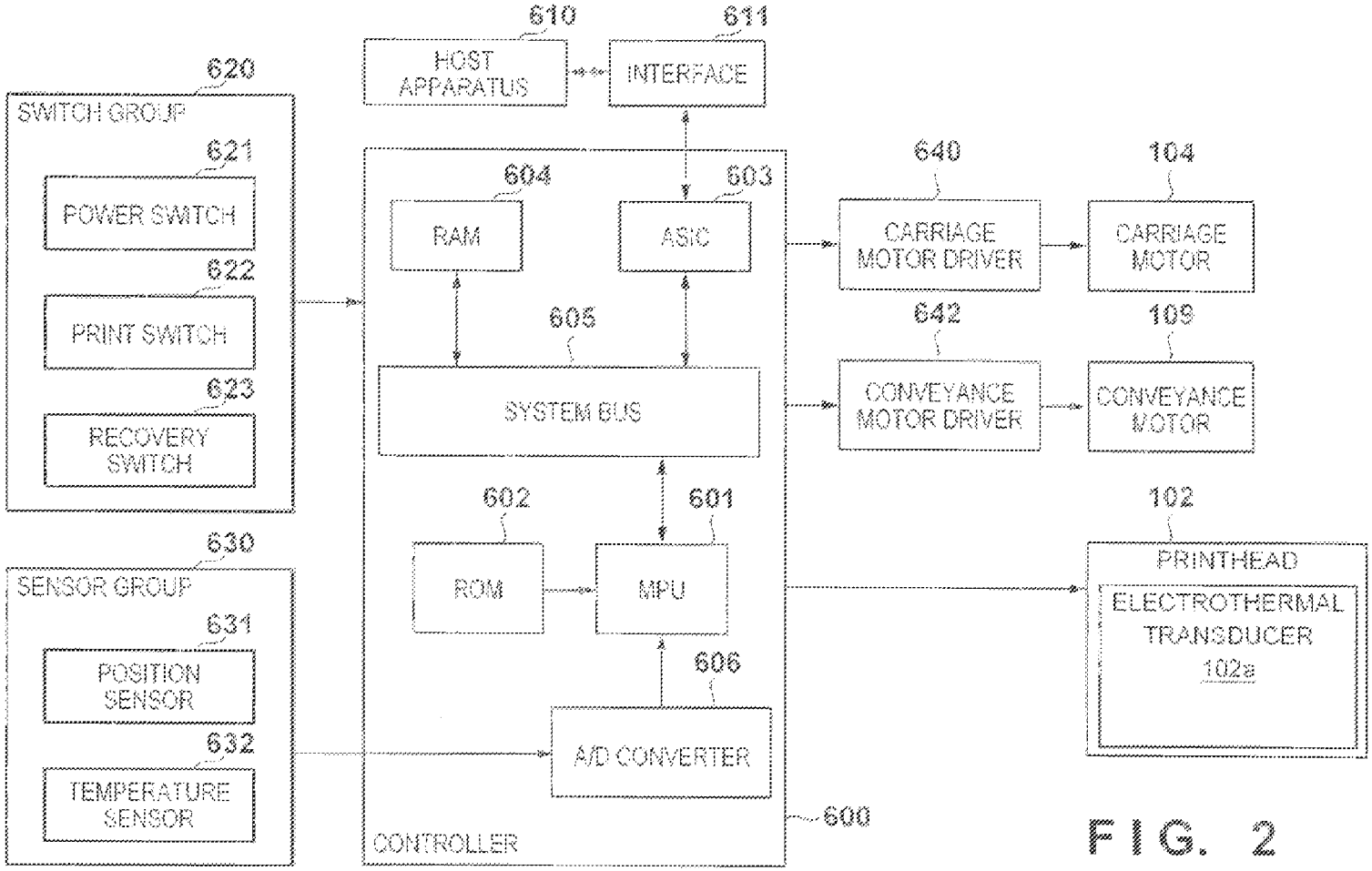
FIG. 2 is a block diagram showing the control arrangement of the printing apparatus shown in FIG. 1.

FIG. 2 is a block diagram showing the control arrangement of the printing apparatus 1 shown in FIG. 1.

As shown in FIG. 2, a controller 600 includes an MPU 601, ROM 602, application specific integrated circuit (ASIC) 603, RAM 604, system bus 605, and A/D converter 606. The ROM 602 stores programs corresponding to control sequences (to be described later), necessary tables, and other permanent data. The ASIC 603 generates control signals for controlling the carriage motor 104, conveyance motor 109, and printhead 102. The RAM 604 is used as an image data rasterization area, a work area for executing a program, and the like. The system bus 605 connects the MPU 601, ASIC 603, and RAM 604 to each other to exchange data. The A/D converter 606 receives an analog signal input from a sensor group (to be described later), A/D-converts it, and supplies the digital signal to the MPU 601.

In FIG. 2, a computer (or a reader for reading an image, a digital camera, or the like) 610 serves as an image data supply source and is generically called a host apparatus. The host apparatus 610 and printing apparatus 1 exchange image data, commands, status signals, and the like via an interface (I/F) 611. The image data is input in, for example, the raster format.

A switch group 620 includes a power switch 621, print switch 622, and recovery switch 623.

A sensor group 630 is used to detect an apparatus state, and includes a position sensor 631 and temperature sensor 632.

A carriage motor driver 640 drives the carriage motor 104 for reciprocally scanning the carriage 101 in directions indicated by the X-axis. A conveyance motor driver 642 drives the conveyance motor 109 for conveying the printing medium 106.

In reciprocal print scanning by the printhead 102, the ASIC 603 transfers, to the printhead, data for driving printing elements (heaters for discharge) while directly accessing the storage area of the RAM 604.

To execute aging processing to be described in the embodiment, the MPU 601 controls driving of the carriage motor 104 via the carriage motor driver 640 and moves the carriage 101 to the home position. Then, the MPU 601 controls to apply a pulse to the printing elements of the printhead 102, perform preliminary discharge, and execute aging processing. The execution control includes control of the preliminary discharge count. The preliminary discharge uses a double pulse. The MPU 601 can further control to change the pre-pulse width, change the amount of energy applied to the printing elements, and change the ink discharge amount in one preliminary discharge operation.

Figure 3A:
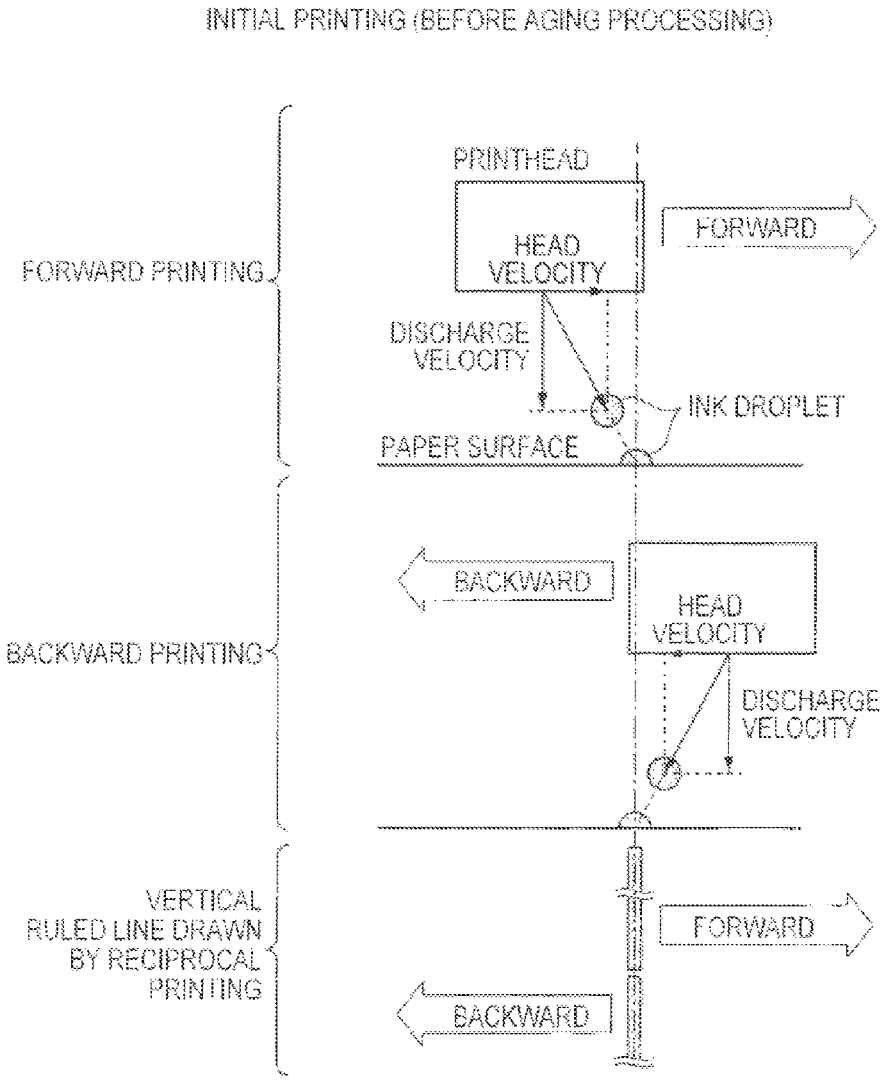
FIGS. 3A and 3B are views for explaining the mechanism of a registration error in the reciprocal scanning direction.
Figure 3B:
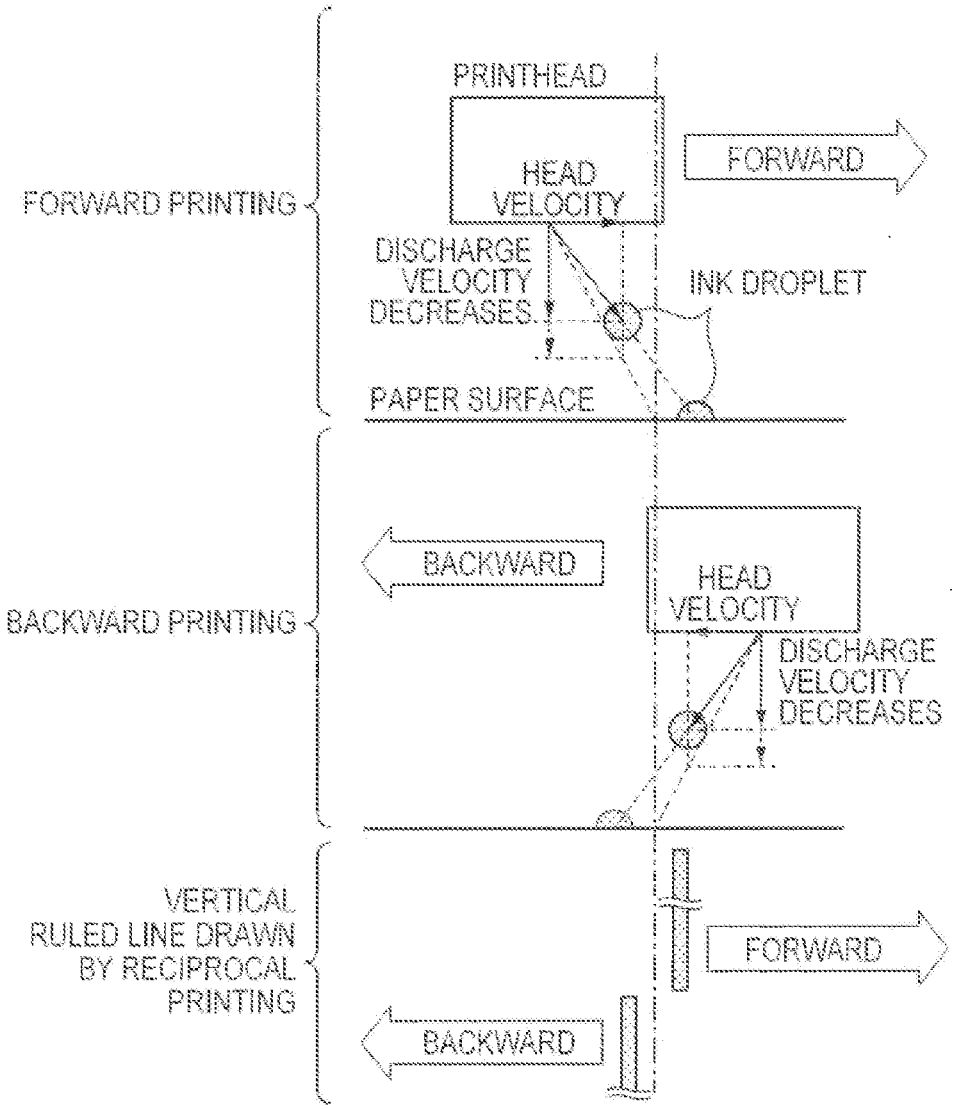

FIGS. 3A and 3B are views for explaining the mechanism of a registration error in the reciprocal direction.

FIG. 3A shows a state in which the printhead performs reciprocal printing before the heater is burned (before aging processing). That is, FIG. 3A shows a state (state in which there is no shift in the horizontal direction in FIG. 3A) in which the seam joints of an image (vertical ruled line in this example) in reciprocal printing are aligned by registration adjustment before a change of the discharge velocity caused by the burn of the heater.

If ink keeps discharged for a while in order to burn the heater, the discharge velocity changes (discharge velocity decreases in this example), and registration in the reciprocal direction in which the seam joints have been initially aligned by registration adjustment is lost, as shown in FIG. 3B.

This is because, for example, in a case where the discharge velocity decreases, the time taken to reach the printing medium (to be referred to as printing paper hereinafter) becomes long and an ink droplet lands on a position slightly shifted from the initial position in the printing direction, as shown in FIG. 3B. Although not shown, even in a case where the discharge velocity increases, the time taken to reach the surface of printing paper becomes shorter than the initial one this time, and an ink droplet lands on a position slightly shifted from the initial position in a direction opposite to the printing direction, generating a shift opposite to that arising in a case where the discharge velocity decreases.

Conventionally, in a case where burn-prone ink is used, aging is performed for the entire nozzle array to stabilize ink discharge in the heaters of all the nozzles (state in FIG. 3B). In this state, registration adjustment is executed to reduce variations of the discharge velocity in subsequent printing. In this way, a registration error is canceled. However, as the number of nozzles of the printhead increases to meet a recent demand for a higher printing speed, problems have surfaced, including an increase in waste ink amount, a decrease in the number of media printable with ink in an ink tank in the initial stage, and an increase in aging time.

Several embodiments for solving these problems will be explained below.

First Embodiment

Figures 4A, 4B:
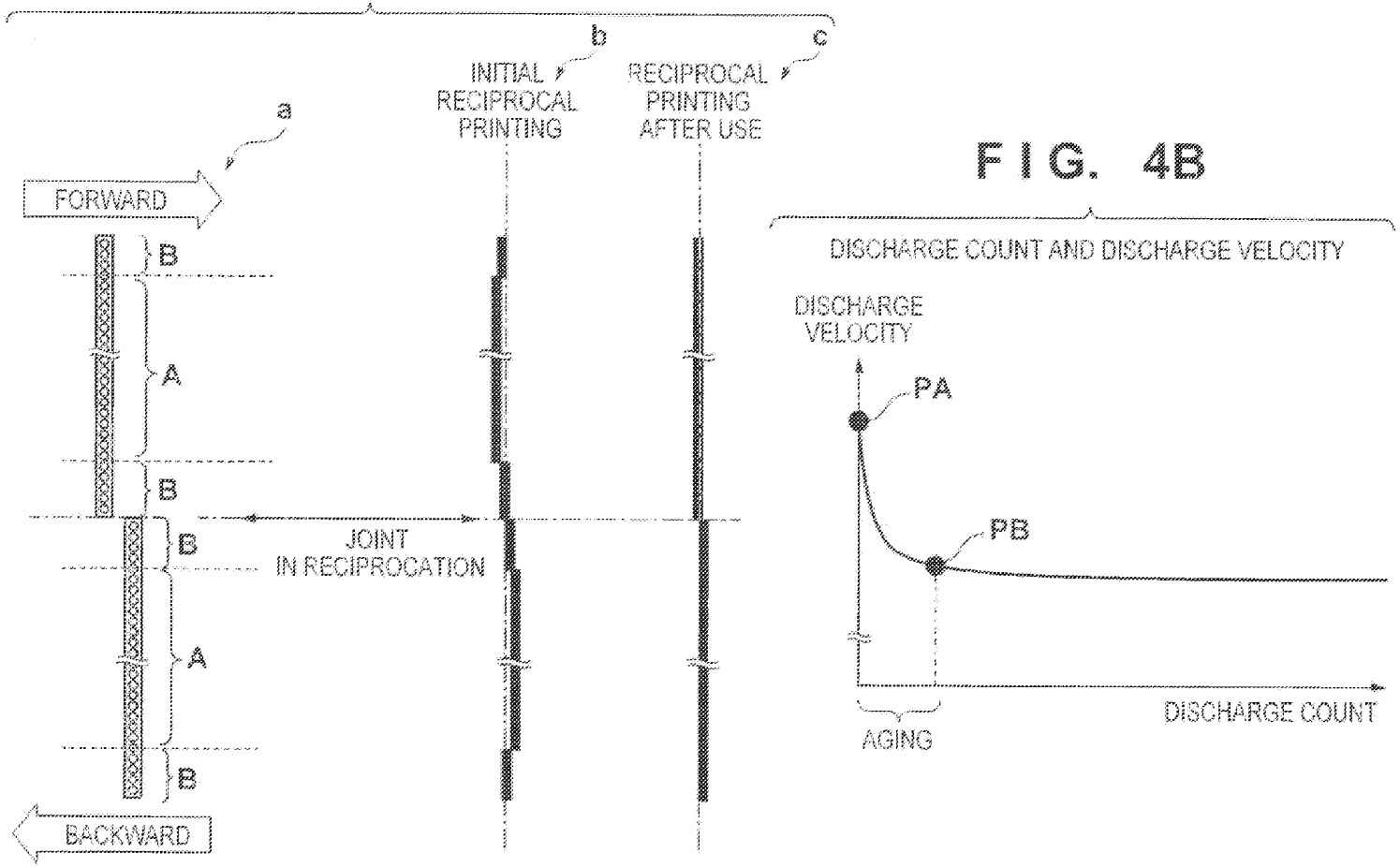
FIGS. 4A and 4B are views for explaining an aging processing method according to the first embodiment.

FIGS. 4A and 4B are views for explaining an aging processing method according to the first embodiment.

In FIG. 4A, a represents a nozzle array used to print by a printhead. In this case, the printhead includes one nozzle array. b and c represent states in which forward printing and backward printing are performed by using the nozzle array. In particular, b represents an image (vertical ruled line) formed by forward printing and backward printing in the initial stage (before aging processing). c represents an image (vertical ruled line) formed by forward printing and backward printing after the printhead is used for a while (after aging processing). This reciprocal printing represents the state of so-called 1-pass printing in which paper is fed or the printhead moves by only the length of a nozzle array used to print.

In FIG. 4A, a represents that aging processing is performed much more for heaters corresponding to nozzles (nozzles to print images near the joint of respective images formed by forward printing and backward printing) on the edge side portion in the nozzle array of the printhead. In the nozzle array (heater array) shown in a of FIG. 4A, the ink discharge count by aging processing is changed at a center side portion A and edge side portion B.

FIG. 4B shows a state in which the ink discharge velocity changes in accordance with the ink discharge count owing to the burn of the heater. Especially, FIG. 4B shows a state in which the ink discharge velocity decreases in accordance with the ink discharge count. In FIG. 4B, PA corresponds to the center side portion A in FIG. 4A, and PB corresponds to the edge side portion B in FIG. 4A. That is, aging processing is not performed (or the aging processing amount is relatively small) at the center side portion of the nozzle array of the printhead, and is performed at the edge side portion of the nozzle array of the printhead. Thus, the ink discharge velocity is PA in FIG. 4B at the center side portion A of the nozzle array shown in FIG. 4A, and aging processing is performed until the ink discharge velocity becomes PB in FIG. 4B at the edge side portion B of the nozzle array shown in FIG. 4B.

In FIG. 4B, PA indicates a discharge velocity in a no-aging state or a state in which the aging processing amount is relatively small. In FIG. 4B, PB indicates a discharge velocity in the saturated state in which the discharge velocity does not substantially change even if the discharge count increases.

In this manner, by using a printhead having undergone aging processing in advance, the amount of which is large only at the edge side portion of the nozzle array (heater array), the embodiment makes a registration error in the reciprocal scanning direction less conspicuous by jointing joints stepwise in reciprocal printing, as represented by c in FIG. 4A. As the use of the printhead increases, the discharge velocity of ink from nozzles at the center side portion of the nozzle array having undergone no aging (or undergone less aging processing) also decreases. As a result, the discharge velocity of ink from nozzles at the edge side portion of the nozzle array having undergone aging processing in advance (or undergone more aging processing), and the discharge velocity of ink from nozzles at the center side portion become equal. Registration adjustment in the reciprocal scanning direction is substantially achieved, and the vertical ruled line is gradually printed to be approximately straight.

According to the above-described embodiment, aging processing is performed for only nozzles at the edge side portion of the printhead. A registration error in the reciprocal scanning direction can be made less conspicuous, the ink amount necessary for aging processing can be reduced, and the waste ink amount can be minimized. Therefore, ink in the ink tank can be effectively used for actual printing, and the number of media printable with the ink contained in the ink tank can be ensured.

In addition, in the first embodiment, aging is performed for only nozzles at the edge side portion of the nozzle array of the printhead, and the heat generation amount of the printhead accompanying aging processing can be suppressed to be small. Since the above-mentioned standby time taken to decrease the temperature of the printhead suffices to be short, the aging processing time can be greatly shortened.

Second Embodiment

Only a characteristic arrangement in the second embodiment will be explained, and a description of the arrangement and features described in the first embodiment will not be repeated. As a feature of the second embodiment, the nozzle aging count is decreased stepwise for nozzles which print images farther from the joint of respective images formed by forward printing and backward printing.

Figures 5A, 5B:
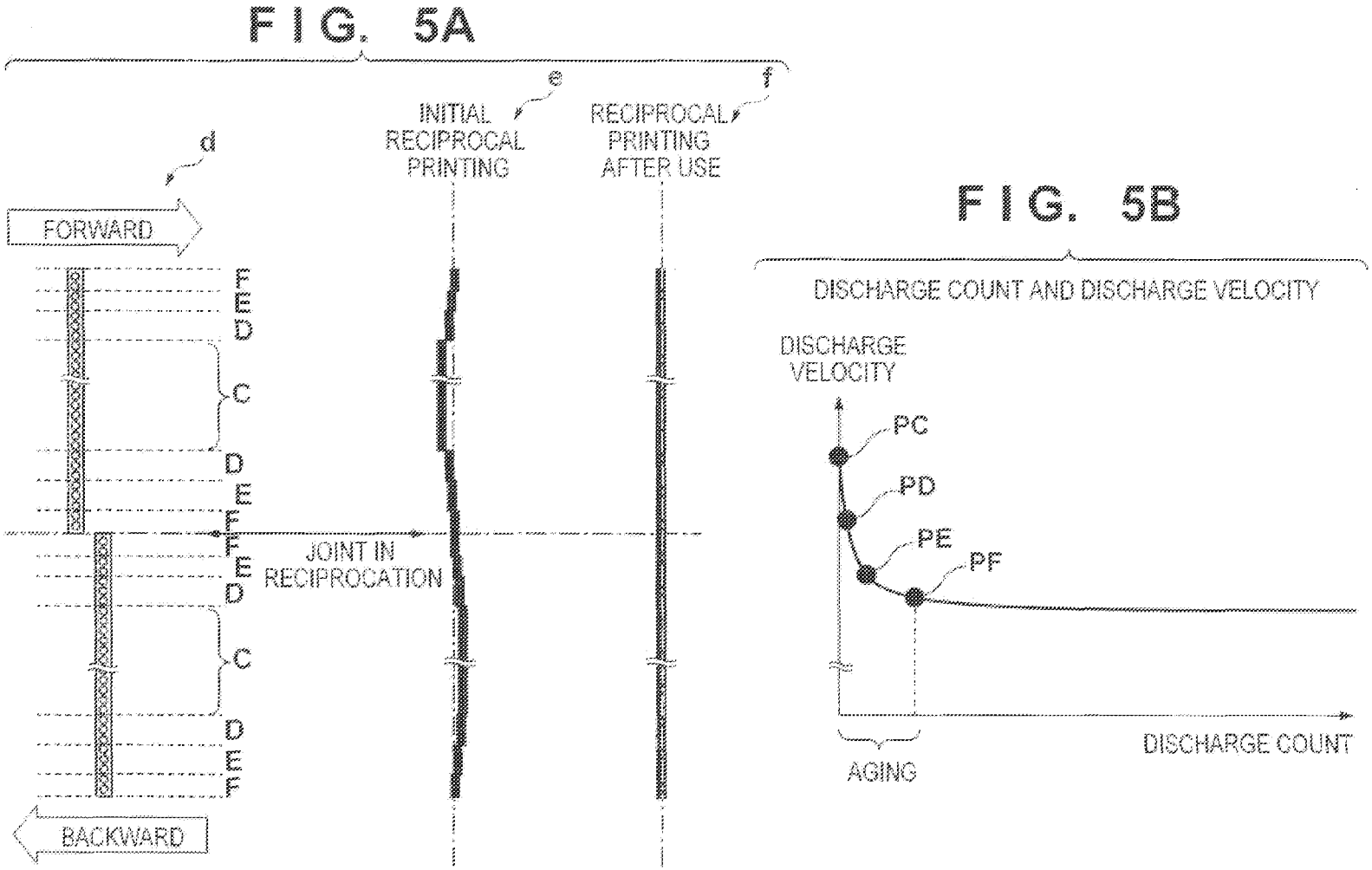
FIGS. 5A and 5B are views for explaining an aging processing method according to the second embodiment.

FIGS. 5A and 5B are views for explaining an aging processing method according to the second embodiment.

In FIG. 5A, d represents a nozzle array used to print by a printhead. In this case, the printhead includes one nozzle array. e and f represent states in which forward printing and backward printing are performed by using the nozzle array. In particular, e represents an image (vertical ruled line) formed by forward printing and backward printing in the initial stage (before aging processing). f represents an image (vertical ruled line) formed by forward printing and backward printing after the printhead is used for a while (after aging processing). This reciprocal printing represents the state of so-called 1-pass printing in which paper is fed or the printhead moves by only the length of a nozzle array used to print.

In FIG. 5A, d represents that aging processing is performed much more stepwise from the edge side portion (nozzles to print images near the joint of respective images formed by forward printing and backward printing) toward the center side portion in the nozzle array of the printhead. In the nozzle array shown in FIG. 5A, the ink discharge count by aging processing is changed stepwise at an edge side portion F, a portion E slightly closer to the center side portion than the edge side portion F, a portion D further closer to the center side portion than the portion E, and a center side portion C.

FIG. 5B shows a state in which the ink discharge velocity changes in accordance with the ink discharge count owing to the burn of the heater. Especially, FIG. 5B shows a state in which the ink discharge velocity decreases in accordance with the ink discharge count (that is, the burn of the heater). In FIG. 5B, PC, PD, PE, and PF correspond to C, D, E, and F in FIG. 5A, respectively.

That is, aging is not performed (or relatively minimum aging processing is performed) at the center side portion in the nozzle array of the printhead shown in FIG. 5A, and the ink discharge velocity is PC in FIG. 5B. Aging is performed much more stepwise (four steps in the embodiment) so as to change the discharge velocity from PC→PD→PE→PF from the edge side portion toward the center side portion of the nozzle array. In FIG. 5B, PC indicates a discharge velocity in a no-aging state or a state in which aging processing is relatively minimum. PF indicates a discharge velocity in the saturated state in which the discharge velocity does not change even if the ink discharge count increases.

In this fashion, the embodiment makes a registration error in the reciprocal direction much less conspicuous by completely jointing joints in reciprocal printing, as represented by f in FIG. 5A, by using a printhead in which aging processing is performed in advance stepwise from the edge side portion toward the center side portion of the nozzle array. As the use of the printhead increases, the discharge velocity of ink from nozzles at the center side portion of the nozzle array having undergone no aging (or undergone less aging processing) also decreases. Hence, the discharge velocity of ink from nozzles at the edge side portion of the nozzle array having undergone aging processing in advance (or undergone more aging), and the discharge velocity of ink from nozzles at the center side portion become equal. Registration adjustment in the reciprocal direction is substantially achieved, and the vertical ruled line is gradually printed to be approximately straight.

According to the above-described embodiment, a registration error in the reciprocal direction can be made much less conspicuous, compared to the first embodiment. By executing aging stepwise from the edge side portion toward the center side portion of the printhead, the ink amount necessary for aging is reduced, and the waste ink amount is also reduced. Ink in the ink tank can be effectively used for actual printing, and the number of media printable with the ink contained in the ink tank can be ensured.

In addition, in the second embodiment, aging is decreased stepwise from the edge side portion toward the center side portion of the nozzle array of the printhead, so the total heat generation amount of printhead can be suppressed to be small. Since the standby time necessary to decrease the temperature of the printhead suffices to be short, the aging processing time can be greatly shortened.

Further, an MPU 601 may control to change the pre-pulse width of a double pulse used in aging processing, increase the amount of energy applied to the printing element, and increase the ink discharge amount. Even if the discharge count is decreased, the same amount of ink can be discharged, and the ink discharge velocity can still reach the saturated state in a short time. As a result, the time for aging processing can be shortened. Aging in the above-described embodiments may be performed before the use of a liquid discharge head in the initial stage. For example, after a liquid discharge head is manufactured, aging may be performed before shipment of the liquid discharge head. Alternatively, aging may be performed at the start of use when the user uses the liquid discharge head for the first time, without performing aging upon manufacturing the liquid discharge head. After aging is performed and a predetermined amount of burn is attached to the heater surface, aging processing need not be performed again. However, in a case where the burn is separately removed to refresh the heater surface, aging processing becomes necessary again.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-266739, filed Dec. 5, 2012 and 2013-211433, filed Oct. 8, 2013, which are hereby incorporated by reference herein in their entirety.

What is claimed is:

1. A printing apparatus in which a printhead including a plurality of electrothermal transducers and a nozzle array formed from a plurality of nozzles configured to correspond to the plurality of electrothermal transducers and discharge ink is reciprocally scanned in a direction different from a direction of the nozzle array, and an image is printed on a printing medium by forward printing and backward printing by the printhead, comprising:

a control unit configured to control to perform aging processing by changing a count at which the aging processing is performed, between the electrothermal transducers corresponding to the nozzles at an edge side portion of the nozzle array and the electrothermal transducers corresponding to nozzles at a center side portion of the nozzle array.

2. The apparatus according to claim 1, wherein the aging processing includes preliminary discharge not contributing to printing.

3. The apparatus according to claim 2, further comprising a recovery unit configured to perform recovery processing for the printhead, wherein part of said recovery unit is used for the preliminary discharge.

4. The apparatus according to claim 1, wherein said control unit is further configured to control to increase an aging count for the nozzles at the edge side portion of the nozzle array to be larger than an aging count for the nozzles at the center side portion of the nozzle array.

5. The apparatus according to claim 1, wherein said control unit is further configured to control to change, gradually from the nozzles at the edge side portion of the nozzle array toward the nozzles at the center side portion of the nozzle array, the count at which the aging processing is performed.

6. The apparatus according to claim 5, wherein said control unit is further configured to control to decrease, gradually from the nozzles at the edge side portion of the nozzle array toward the nozzles at the center side portion of the nozzle array, the count at which the aging processing is performed.

7. The apparatus according to claim 1, wherein a discharge velocity of ink from the nozzle of the printhead decreases in accordance with the count of the aging processing, and reaches a discharge velocity in a saturated state in which the discharge velocity does not substantially change even if an ink discharge count accompanying the aging processing increases.

8. The apparatus according to claim 2, wherein said control unit is further configured to control to change a pre-pulse width of a double pulse applied to the electrothermal transducer and increase energy applied to the electrothermal transducer in preliminary discharge of the aging processing.

9. An aging method for a printing apparatus in which a printhead including a plurality of electrothermal transducers and a nozzle array formed from a plurality of nozzles configured to correspond to the plurality of electrothermal transducers and discharge ink is reciprocally scanned in a direction different from a direction of the nozzle array, and an image is printed on a printing medium by forward printing and backward printing by the printhead, comprising:

controlling to perform aging processing by changing a count at which the aging processing is performed, between nozzles at an edge side portion of the nozzle array and nozzles at a center side portion of the nozzle array.

10. The method according to claim 9, wherein the aging processing includes preliminary discharge not contributing to printing.

11. The method according to claim 9, wherein the control includes control to increase an aging count for the electrothermal transduces corresponding to the nozzles at the edge side portion of the nozzle array to be larger than an aging count for the electrothermal transduces corresponding to the nozzles at the center side portion of the nozzle array.

12. The method according to claim 9, wherein the control includes control to change, gradually from the nozzles at the edge side portion of the nozzle array toward the nozzles at the center side portion of the nozzle array, the count at which the aging processing is performed.

13. The method according to claim 12, wherein the control further includes control to decrease, gradually from the nozzles at the edge side portion of the nozzle array toward the nozzles at the center side portion of the nozzle array, the count at which the aging processing is performed.

14. The method according to claim 9, wherein a discharge velocity of ink from the nozzle of the printhead decreases in accordance with the count of the aging processing, and reaches a discharge velocity in a saturated state in which the discharge velocity does not substantially change even if an ink discharge count accompanying the aging processing increases.

15. The method according to claim 10, wherein the control includes control to change a pre-pulse width of a double pulse applied to the electrothermal transducer and increase energy applied to the electrothermal transducer in preliminary discharge of the aging processing.

16. An aging method for a liquid discharge head, comprising:

providing a liquid discharge head including an electrothermal transducer array in which a plurality of electrothermal transducers configured to generate energy to be used to discharge a liquid are arrayed, and a plurality of orifices configured to be formed in accordance with the electrothermal transducers and discharge a liquid; and performing aging processing for at least part of the plurality of electrothermal transducers included in the electrothermal transducer array, wherein an aging count for electrothermal transducers at an edge side portion of the electrothermal transducer array is larger than an aging count for electrothermal transducers at a center side portion of the electrothermal transducer array.

17. The method according to claim 16, wherein the aging processing includes preliminary discharge not contributing to printing.

18. The method according to claim 16, wherein the aging processing is performed at a start of initial use of the liquid discharge head.

19. The method according to claim 16, wherein the aging processing is performed before shipment of the liquid discharge head.

* * * * *